US007656374B2

(12) United States Patent
Shen et al.

(10) Patent No.: US 7,656,374 B2
(45) Date of Patent: Feb. 2, 2010

(54) METHOD FOR ENHANCING RESPONSE SPEED OF HOLD-TYPED DISPLAY DEVICE

(75) Inventors: Yuh-Ren Shen, Tai-Nan (TW); Yu-Lin Lee, Taipei (TW); Chang-Cheng Lin, Taipei (TW)

(73) Assignee: Vastview Technology, Inc., Hsinchu (TW)

( * ) Notice: Subject to any disclaimer, the term of this patent is extended or adjusted under 35 U.S.C. 154(b) by 557 days.

(21) Appl. No.: 11/469,888

(22) Filed: Sep. 4, 2006

(65) Prior Publication Data

US 2008/0055229 A1 Mar. 6, 2008

(51) Int. Cl.
*G09G 3/36* (2006.01)

(52) U.S. Cl. ..... 345/87; 345/98

(58) Field of Classification Search ..... 345/3.2, 345/87, 98

See application file for complete search history.

(56) References Cited

U.S. PATENT DOCUMENTS

| | | | | |
|---|---|---|---|---|
| 7,038,651 | B2 * | 5/2006 | Nitta et al. | 345/98 |
| 2004/0041745 | A1 * | 3/2004 | Chen | 345/3.2 |
| 2006/0038759 | A1 * | 2/2006 | Hong et al. | 345/87 |
| 2007/0296655 | A1 * | 12/2007 | Jiang et al. | 345/87 |

* cited by examiner

*Primary Examiner*—Amare Mengistu
*Assistant Examiner*—Premal Patel
(74) *Attorney, Agent, or Firm*—WPAT, P.C.; Anthony King; Kay Yang

(57) ABSTRACT

The method increases the output frame rate to p/q (p, q are both natural numbers and p>q) times of the input frame rate. In a period of time equal to the least common multiple of the input and output frame times, q input frames are output and (p−q) transient frames are generated and inserted at appropriate places before or after the q input frames in the output frame sequence so as to enhance the dynamic display effect of the display device.

22 Claims, 12 Drawing Sheets

METHOD FOR ENHANCING RESPONSE SPEED OF HOLD-TYPED DISPLAY DEVICE

BACKGROUND OF THE INVENTION

1. Field of the Invention

The present invention generally relates to methods for enhancing the response speed of hold-typed display devices, and more particularly to a method increasing the output frame rate in a way to achieve response speed enhancement.

2. The Prior Arts

The liquid crystal display (LCD) devices have been the mainstream display technology in recent years. However, due to the physic property of liquid molecules, LCD devices are significantly inferior to the cathode ray tube (CRT) display devices in terms of response speed. Therefore, this has been the major research and development focus for both industrial and academic arenas.

FIG. 1*a* is a schematic diagram showing the architecture of a conventional LCD device. As illustrated, the LCD device contains a direct-lit backlight module (denoted as "LED backlight") using multiple LEDs arranged in a number of horizontal rows (denoted as "BL1," "BL2," "BL3," and so on). Each row of LEDs is driven by a driver which in turn is controlled by a driver control circuit. The backlight module usually contains a diffuser so as to scatter the light beams emitted from the LEDs into uniform planar light. The LCD panel, on the other hand, contains multiple vertically aligned data lines D1, D2, . . . , Dm (only D1 is depicted) and horizontally aligned scan lines G1, G2, . . . , Gn (only G1 is depicted). A pixel of the LCD panel is located at the intersection of a data line and a scan line (e.g., the pixel P1 is located at where D1 and G1 intersect). Each data line is driven by a data driver while each scan line is enabled by a gate driver. The data drivers and gate drivers are controlled by a control board of the LCD device.

The brightness of a pixel (e.g., P1) is determined by the backlight and the gray level of the pixel P1 which is the result of enabling the scan line G1 by a gate driver and then exerting a driving voltage over the data line D1 by a data driver. Under the operation of the driving voltage, the gray level of the pixel P1 gradually approaches, instead of directly becomes a target gray level. Due to such a delay property of the liquid molecules, LCD device is commonly referred to as a hold-typed display device where residuals and therefore blurs in the displayed images are inevitable especially when dynamic images are presented. To solve this problem, various methods for accelerating the response speed of LCD device have been disclosed in the art. FIG. 1*b* is a timing diagram showing the waveforms of various signals of the LCD device of FIG. 1*a*. Please note that a technique called column inversion is adopted by the LCD device of FIG. 1 which one of the techniques to periodically reverse the polarity of the driving voltage applied to a liquid molecule without affecting its gray level so that the liquid molecule will not be damaged by a constant driving voltage applied for an extended period of time. In the diagram, the Vsync waveform shows the vertical synchronization signal from of LCD device, G1~Gn waveforms show the enablement signals of the scan lines G1~Gn whose pulse width is determined by the horizontal synchronization signal, Hsync, of the LCD device, D1 waveform shows the driving voltage applied to the data line D1, Vlc waveform shows the voltage level of the pixel P1, B1 waveform shows the control signal applied to the backlight module, and P1 waveform shows the variation of the brightness (i.e., gray level) of the pixel P1.

As shown in FIG. 1*b*, assuming that the pixel P1 has a target gray level corresponding to a voltage level (hereinafter, the target voltage level) code 16 in frame N−1 and the target voltage level code200 in frame N. If the driving voltage code200 is applied to the pixel P1 during the frame N, the gray level of the pixel P1 gradually approaches the target gray level (denoted as "Target") as shown by the curve marked as "original." A conventional acceleration technique is to apply an overdriving voltage code220 that is larger than the original voltage level code200. The gray level of the pixel P1 approaches the target gray level in frame N in a faster speed as shown by the curve marked as "overdriving." Another conventional technique is to apply an overdriving voltage code230 to the pixel P1 in the first half of the time showing frame N (hereinafter, the frame time) and the driving voltage code200 in the second half of the frame time. This approach requires that the frame rate being doubled from the standard 60 Hz to 120 Hz and is therefore referred to as an overdriving method of double frame rate (DFR). In this approach, the gray level of the pixel P1 approaches the target gray level in frame N in an even faster speed as shown by the curve marked as "DFR overdriving." Please note that, as shown by the curve BL, the backlight is always turned on.

The aforementioned DFR overdriving method has proven to be effective in enhancing the response speed of the LCD device. As shown in FIG. 1*c*, from the point of view of the control board of the LCD device using the DFR overdriving method, the frames input into the control board in the 60-Hz frame rate are denoted in a timing sequence marked as "Input frames," and the frames output from the control board in the 120-Hz frame rate are denoted in another timing sequence marked as "Output frames." During the first half of the frame time of the input frame N+1, for example, the control board outputs the data of the frame N again as data for the frame N+1 is not yet completely received by the control board. Then, in the second half of the frame time of the input frame N+1, the control board is able to output the data of the frame N+1 from the data already collected from the first half of the input frame time and the data concurrently received in the second half of the input frame time. In other words, the DFR overdriving method would output the data of an input frame twice (one using overdriving voltages and one using target driving voltages). This repetition would cause some interruptions for dynamic images but these interruptions are usually so short to notice for human eyes.

Another similar acceleration method also using DFR is to output a completely black frame in the first half of the input frame time of, say, frame N+1, and then to output the data of the frame N+1 using target driving voltages. A variation of the method is to output the completely black frame in the second half of the input frame time of, say, frame N+1. This so-called black-insertion approach has an advantage in achieving a display effect comparable to the impulse-typed display device such as CRT.

SUMMARY OF THE INVENTION

The present invention provides a novel acceleration method to enhance the response speed of hold-typed display devices such as LCD devices.

The major object and feature of the present invention is to increase output the frame rate to p/q (p, q are both natural numbers and p>q) times of the input frame rate. The present method therefore output (or scans) p output frames during q input frame times. The present method generates the data for the (p−q) additional output frames and inserts these transient frames at appropriate places in the output frame sequence so as to enhance the dynamic display effect of the display device.

An embodiment of the present invention is to integrate the overdriving method with the foregoing frame rate acceleration and transient frame insertion. In this embodiment, whenever a "new" frame is output (i.e., different from the immediately previous output frame), the pixels of the new frame are applied with an overdriving voltages. On the other hand, if a frame being output is a repetition of the immediately previous output frame, the pixels of the repeated frame are applied with their target driving voltages.

Another embodiment of the present invention is to integrate the black-insertion method with the foregoing frame rate acceleration and transient frame insertion. In this embodiment, one of every two adjacent output frames, whether it is a transient frame or not, is always replaced a completely black frame so as to simulate an impulse-typed display device. Furthermore, when a frame is output for three times in a row, two consecutive ones of the three frames are applied with the target driving voltages or, further, the second one of the two is applied with a driving voltage lower than the target driving voltage so as to balance the gray level to its target level.

The present invention can also integrate the control of the direct-lit backlight module to achieve better enhancement to the display device.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention can be applied to LCD devices, plasma display devices, or organic light emitting display (OLED) devices. For simplification, a LCD device is assumed in explaining the following embodiments of the present invention.

Figure 2A:
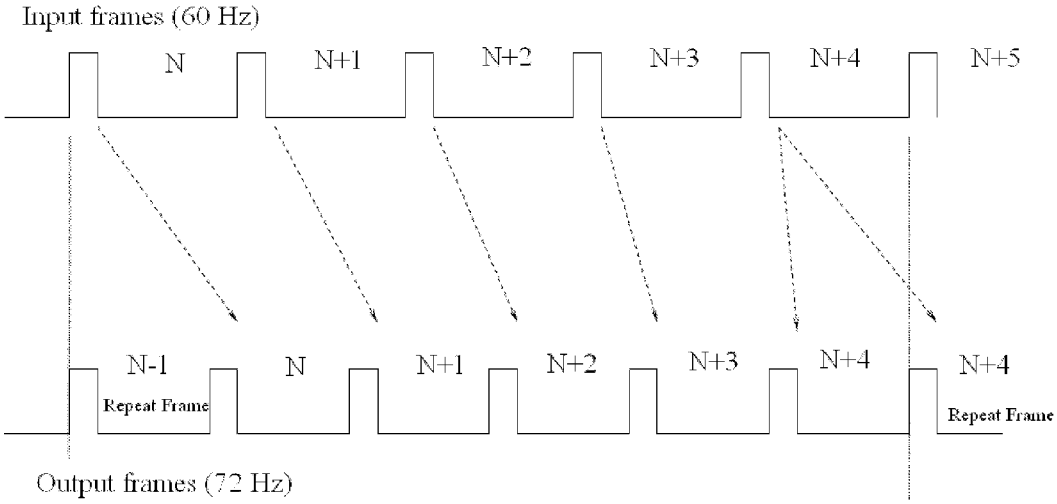
FIG. 2*a* is a timing diagram showing the input and output frame sequences according to an embodiment of the present invention where the output frame rate is increased to 1.2 times of the input frame rate.

The major feature of the present invention is to increase the output frame rate up to p/q times of the input frame rate, where p, q are both natural number and p is greater than q (p>q). Therefore, in a period of time T where q input frames are scanned, the present invention will generate p output frames. In other words, the period T is the least common multiple of the input frame time and the output frame time. FIG. 2*a* is a timing diagram showing the input and output frame sequences according to an embodiment of the present invention where the output frame rate is increased to 1.2 (i.e., p=6 and q=5) times of the input frame rate. Assuming that the input frame rate is 60 Hz, the input frames N, N+1, N+2, are denotes as the "Input frames," while the output frames under the 72(=60x1.2) Hz frame rate are denoted as the "Output frames." Within the period T bounded by the two vertical lines, there is one additional output frame than the five input frames. The present invention is therefore mainly about how to generate the additional frame (or frames).

Figure 2B:
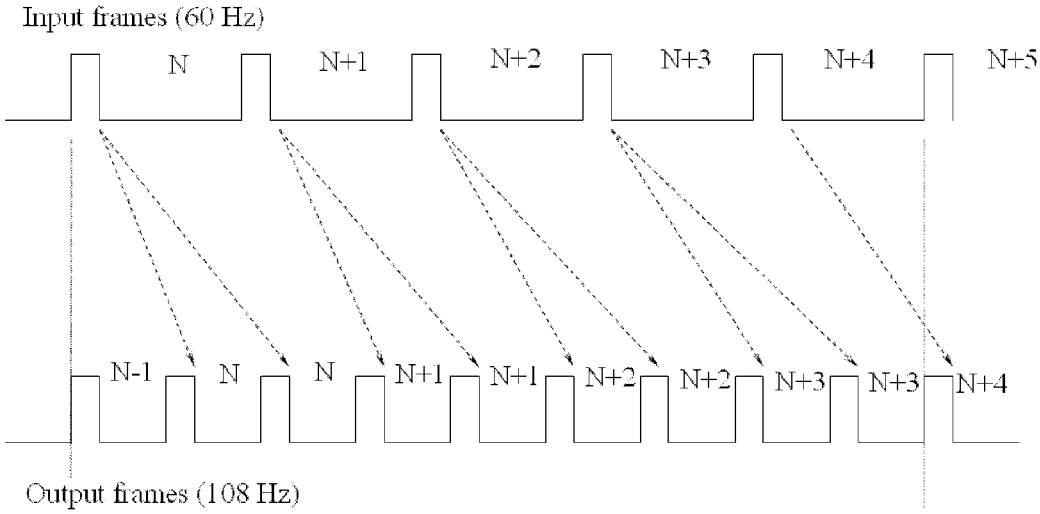
FIG. 2*b* is a timing diagram showing the input and output frame sequences according to an embodiment of the present invention where the output frame rate is increased to 1.8 times of the input frame rate.

As illustrated, as the data for the input frame N is not completely received in the beginning of the period T, the present embodiment output the data from the previous output frame (i.e., frame N−1) again (marked as "repeat frame"). Subsequently, the remaining five output frames are delivered in accordance with the five input frames. FIG. 2*b* is a timing diagram showing the input and output frame sequences according to an embodiment of the present invention where the output frame rate is increased to 1.8 (i.e., p=9 and q=5) times of the input frame rate, which means that four additional output frames have to be generated. In the present embodiment, every input frame is repeated once in the output frames, except the every fifth frame N−1, N+4, and so on.

Figure 2C:
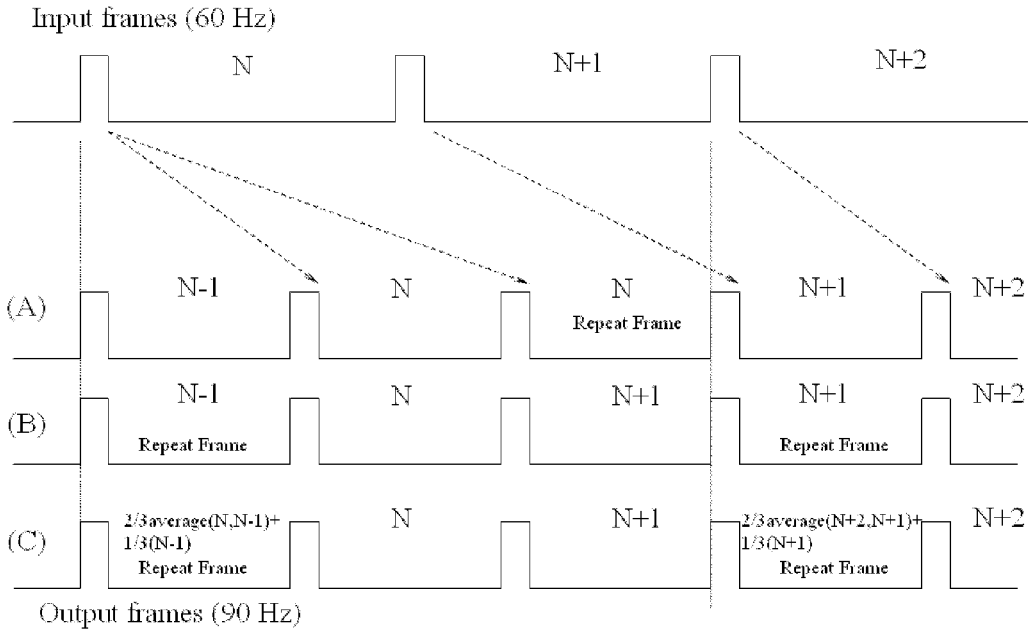
FIG. 2*c* is a timing diagram showing the input and output frame sequences according to three embodiments of the present invention where the output frame rate is increased to 1.5 times of the input frame rate.

As can be imagined from FIGS. 2*a* and 2*b*, there are various ways to generate the additional output frames. To further illustrated these variations, FIG. 2*c* is a timing diagram showing the input and output frame sequences according to three embodiments of the present invention where the output frame rate is increased to 1.5 (i.e., p=3, q=2) times of the input frame rate. As illustrated, the two input frames received in the period T is frame N and frame N+1 while the three output frames in the same period can be frames N−1, N, N (i.e., the output frame sequence marked as (A)), or frames N−1, N, N+1 (i.e., the output frame sequence marked as (B)). As to the output frame sequence marked as (C), the present embodiment generates the first output frame in the period T based on the complete data of the input frame N−1 already received and the partial data of the input frame N concurrently received. During the first output frame (marked as "repeat frame"), only first q/p portion of the data for the input frame N is received and, therefore, q/p portion of the first output frame can be calculated based on q/p portion of the data for frame N−1 and first q/p portion of the data from frame N. For the rest (i.e., 1−q/p portion) of the first output frame, it has to be generated entirely based on the (1−q/p) portion of the frame N−1. In the present embodiment, the calculation of the data is average (i.e., adding the corresponding pixels' gray levels from the two frames and divided the sum by two). As illustrated, ⅔ of the first output frame is obtained by averaging ⅔ of the frame N−1 and ⅔ of the frame N+1 (marked as "⅔average (N, N−1)) and the remaining ⅓ of the first output frame is obtained solely from ⅓ of the frame N−1 (marked as "⅓(N−1)).

Please note that there are various other ways of calculation other than averaging. Using some sort of calculation to generate the additional output frame has the advantage that, even without the application of overdriving voltages, a smooth display effect for dynamic images without interruption can be achieved by the insertion of these transient output frames.

In a brief summary, the present invention increases the output frame rate up to p/q (p, q are both natural numbers and p>q) times and, in a period of time T equal to the least common multiple of the input and output frame times, q input frames are output and (p−q) transient frames are generated and inserted at appropriate places before or after the q input frames in the output frame sequence. The data for the transient frame can be the result of a function $f(F_{M-1}, F_M)$ where $F_{M-1}$ is the latest input frame completely received and $F_M$ is the input frame currently received. For the embodiments shown in FIGS. 2*a* and 2*b* where the input frames are output twice can be considered a special case for the above principle where:

$$f(F_{M-1}, F_M)=F_{M-1}$$

Again using FIG. 2*a* (p=6, q=5) as an example, the present invention can generate one of the following output frame sequences:

$$f(F_{N-1}, F_N), F_N, F_{N+1}, F_{N+2}, F_{N+3}, F_{N+4}$$

$$F_{N-1}, f(F_{N-1}, F_N), F_N, F_{N+1}, F_{N+2}, F_{N+3}$$

$$F_{N-1}, F_N, f(F_N, F_{N+1}), F_{N+1}, F_{N+2}, F_{N+3}$$

$$F_{N-1}, F_N, F_{N+1}, f(F_{N+1}, F_{N+2}), F_{N+2}, F_{N+3}$$

$$F_{N-1}, F_N, F_{N+1}, F_{N+2}, f(F_{N+2}, F_{N+3}), F_{N+3}$$

$$F_{N-1}, F_N, F_{N+1}, F_{N+2}, F_{N+3}, f(F_{N+3}, F_{N+4}),$$

Please note that more than one transient frames can be output consecutively. In an embodiment where p=5 and q=2, a possible output frame sequence is:

$$f_1(F_{N-1}, F_N), f_2(F_{N-1}, F_N), F_N, f_3(F_N, F_{N+1}), F_{N+1}$$

Please also note that, in this example, the three additional transient frames can be generated using different functions $f_1$, $f_2$, $f_3$, respectively. The present invention does not dynamically change the calculating function or the insertion place of a transient frame. Instead, under pre-determined p and q values and for the (q+1) possible insertion places for the transient frames, the present invention consistently generates a fixed number of transient frame, each using a specific function, and places them at specific insertion places. The increase of the frame rate up to p/q times can be easily achieved by adjusting the clock generation circuit in the control board. The calculation and insertion of the transient frames can be carried out by the firmware of the control board. All these implementation details should be quite straightforward to people of the related art.

Figure 3:
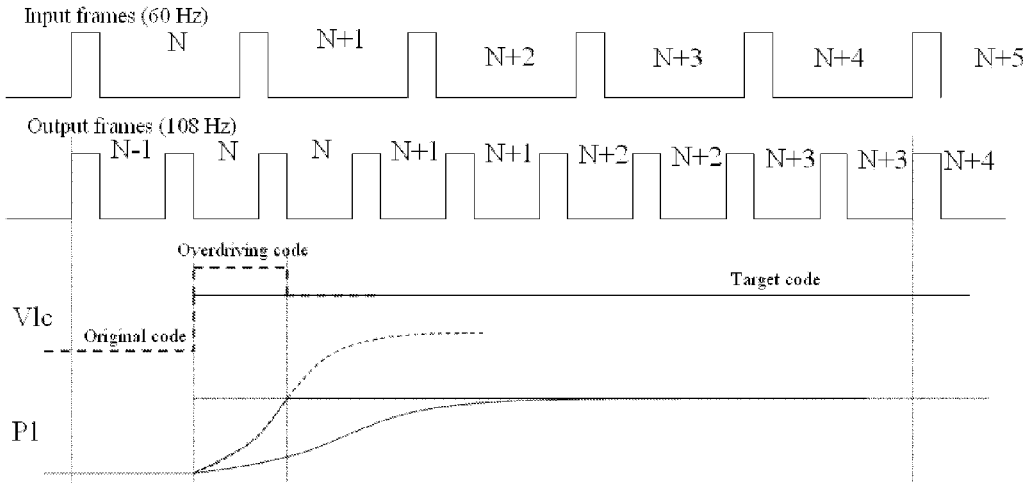
FIG. 3 is a timing diagram showing the input and output frame sequences of FIG. 2*b* and the waveforms of various signals when overdriving is integrated according to an embodiment of the present invention.

The conventional overdriving technique can be integrated into the present invention to achieve even better enhancement of the response speed of the LCD device. FIG. 3 is a timing diagram showing the input and output frame sequences of FIG. 2*b* where the output frame rate is raised up to 1.8 times and the waveforms of various signals when overdriving is integrated. As described earlier, the second frame N, the second frame N+1, the second frame N+2, and the second frame N+3 in the output frame sequence are all transient frames and are generated by simple repetition. The way to integrate overdriving is, when a "new" output frame is generated that is different from the immediately previous output frame, whether it is a transient frame or not, the pixels of the new output frame are always applied with appropriate overdriving voltages. On the other hand, if an output frame is identical to the immediately previous output frame, the pixels of the repeated output frame are applied with their target driving voltages. As illustrated, assuming that the pixel P1 has target driving voltages marked as "original code" and "target code" for the input frame N−1 and N respectively, the present embodiment, in addition to producing the depicted output frame sequence, an overdriving voltage denoted as "overdriving code" is applied to the pixel P1 when the frame N is output for the first time and the target driving voltage is applied in the transient frame where the frame N is output for the second time. Please note that, for simplicity, the waveforms of the pixel P1's voltage level and gray level are not shown for the subsequent frames. It has to be pointed out that, even when the transient frames are not produced by repeating the previous output frames, the same principle can still be adopted by applying appropriate overdriving voltages to the pixels of the transient frames.

Figure 4A:
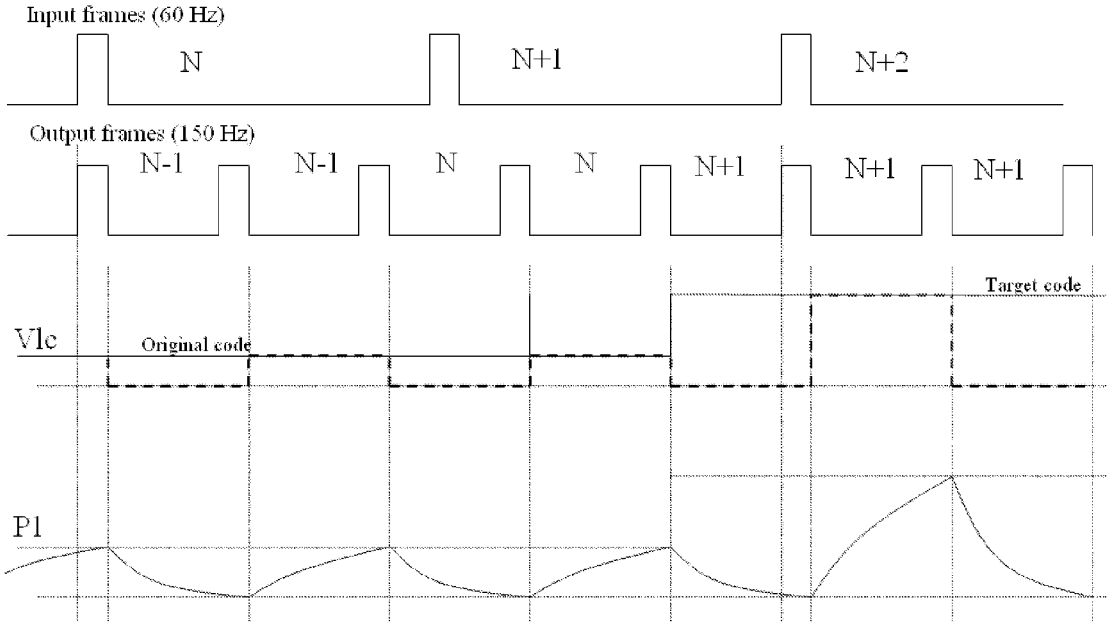
FIG. 4*a* is a timing diagram showing the input and output frame sequences where the output frame rate is increased up to 2.5 times and the waveforms of various signals when black-insertion is integrated according to an embodiment of the present invention.

The conventional black-insertion technique can be integrated into the present invention as well so as to achieve a display effect comparable to the impulse-type display device. FIG. 4*a* is a timing diagram showing the input and output frame sequences of an embodiment where the output frame rate is increased up to 2.5 (i.e., p=5, q=2) times and the waveforms of various signals when black-insertion is integrated. As illustrated, the pixel P1 has target driving voltages marked as "original code" for the input frame N−1 and N, and marked as "target code" for the input frame N+1, respectively. In addition, within the period T, the present embodiment produces two transient frames before outputting the frame N by repeating the frame N−1 two more times and a transient frame before outputting the frame N+1 by repeating the frame once. What is shown in FIG. 4*a* is the simplest way of black insertion and is also the one identical to the conventional approach. That is, the present embodiment always replaces one of every two adjacent output frames, whether it is a transient frame or not, by a black frame. Therefore, as shown by the waveform Vlc, the driving voltage of the pixel P1 is turned off during these black frames. In this way, a display effect similar to the impulse-typed display device can be achieved and the flickering of the images can be avoided as well. However, these advantages are at the cost of reduced brightness.

Figure 4B:
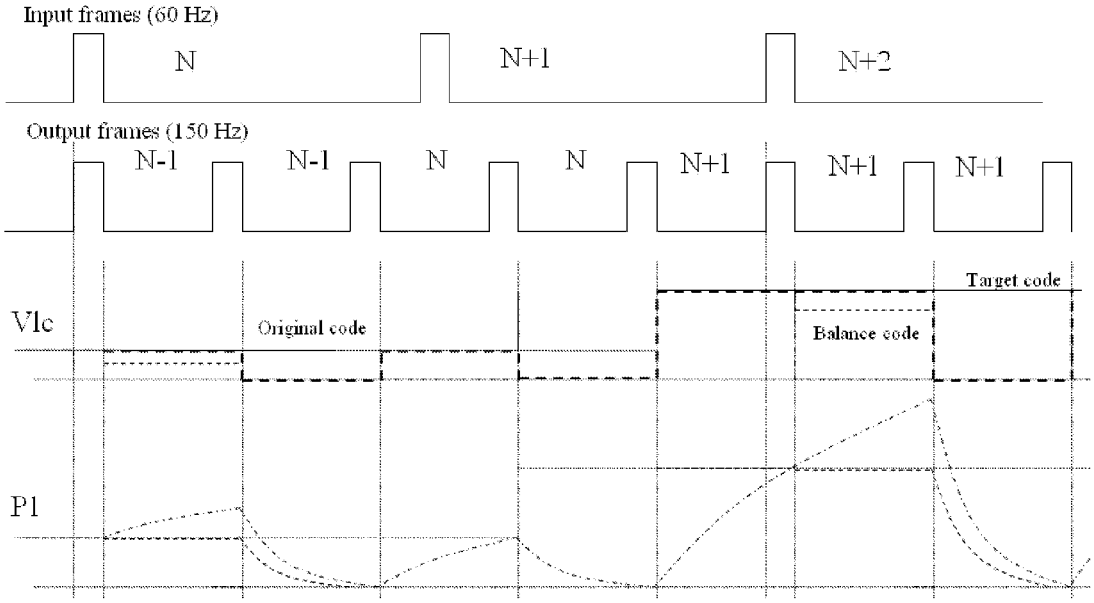
FIG. 4*b* is a timing diagram showing the input and output frame sequences where the output frame rate is increased up to 2.5 times and the waveforms of various signals when black-insertion is integrated according to two embodiments of the present invention.

FIG. 4*b* is a timing diagram showing the input and output frame sequences where the output frame rate is increased up to 2.5 times and the waveforms of various signals when black-insertion is integrated according to two embodiments of the present invention. The two embodiments are specifically applied to scenarios where the transient frames are produced by repetition and the knowledge about the frame data is utilized to decide how to conduct the black insertion. Generally, when transient frames are produced by repetition, there could be two or even three identical output frames (e.g., the frame N−1 and the frame N+1 of FIG. 4*c*) depending on the ratio of frame rate increase. For the two embodiments shown in FIG. 4*b*, it basically still replaces one of every two adjacent output frames by a black frame. However, when three identical output frames are produced in a row, the pixels of two consecutive output frames of the three output frame are applied with their target driving voltages. These two frames could the first two as shown in FIG. 4*b* or the last two. In this way, the brightness of the LCD device can be improved than simple black insertion. However, as shown by the waveform P1 in FIG. 4*b*, the gray level of the pixel P1 would overshoot past its target gray level as the target driving voltage is applied in two consecutive frames. To overcome this problem, another embodiment shown in FIG. 4*b* applied a driving voltage (denoted as "balance code") lower than the target driving voltage to the pixels of the second frame of the two consecutive output frames so as to balance the gray level of the pixel P1 back to its target gray level.

Figure 1A:
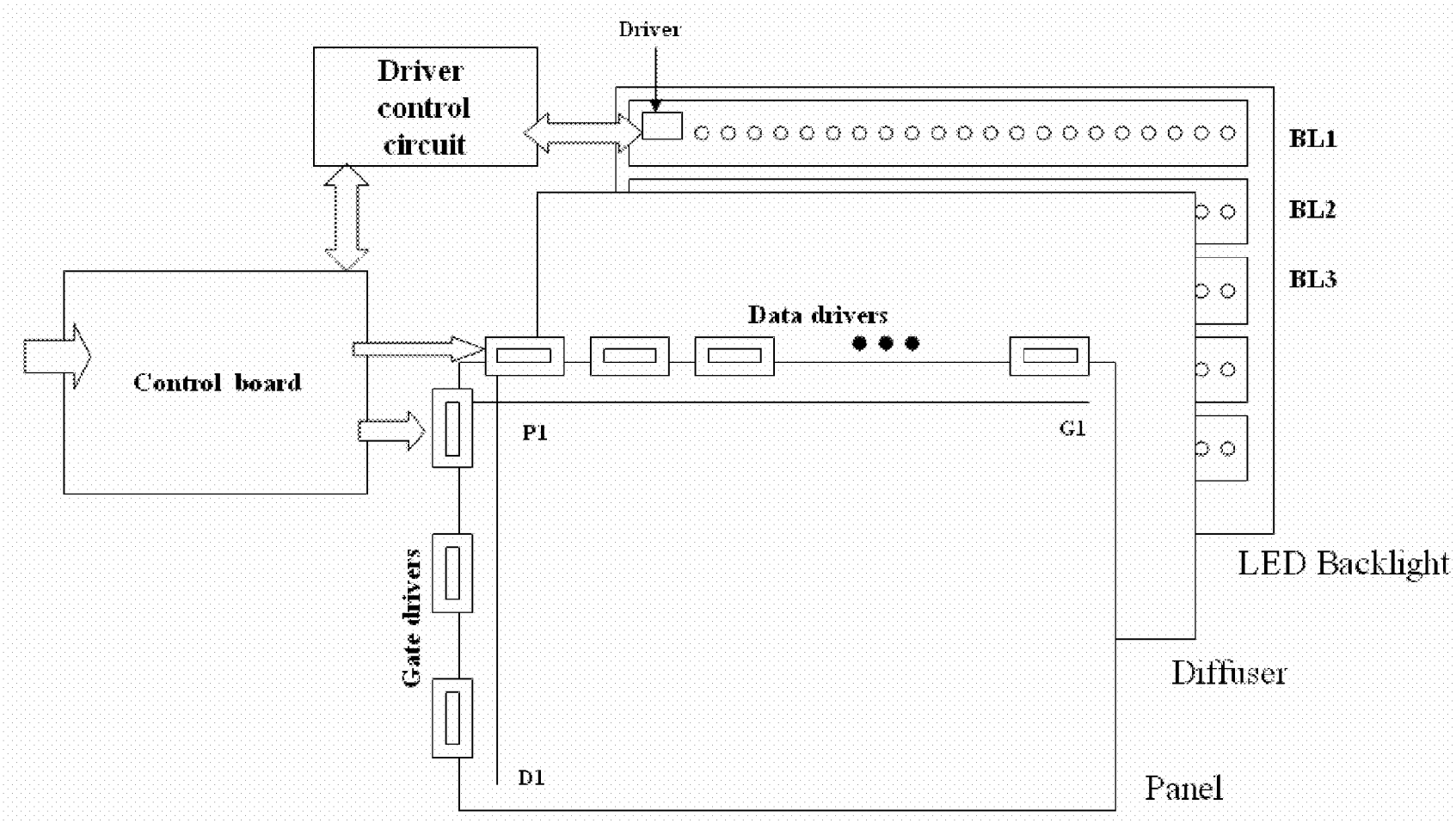
FIG.1a (Prior Art)
FIG. 1*a* is a schematic diagram showing the architecture of a conventional LCD device using LED as backlight.

As mentioned earlier, the brightness of a pixel is determined by the pixel's gray level and the backlight. Therefore, by turning off the backlight behind the pixel during the time its gray level is accelerated to approach the target gray level as shown in FIG. 3, residuals of dynamic images within these transient processes can be prevented from manifesting themselves. Similarly, when black insertion is conducted in FIGS. 4*a* and 4*b*, the black frames will be "darker" if the backlight is turned off when black frames are output. The LCD device will behave more like a CRT display device. The aforementioned integration of backlight control with the present invention can be applied to the LED-based direct-lit backlight module shown in FIG. 1*a*, or it can be applied to a direct-lit backlight module using cold cathode fluorescent lamp (CCFL) tubes as light source. Regardless of the light source being CCFLs or LEDs, these direct-lit backlight modules are characterized by having horizontal rows of light source (e.g., a row of LEDs or a lamp tube) that can be independently turned or off. Pretty much all LED-based or CCFL-based, direct-lit backlight modules have these characteristics. Please note that the number of scan lines in the LCD panel is not necessarily identical to the number of rows of light source.

Figure 1B:
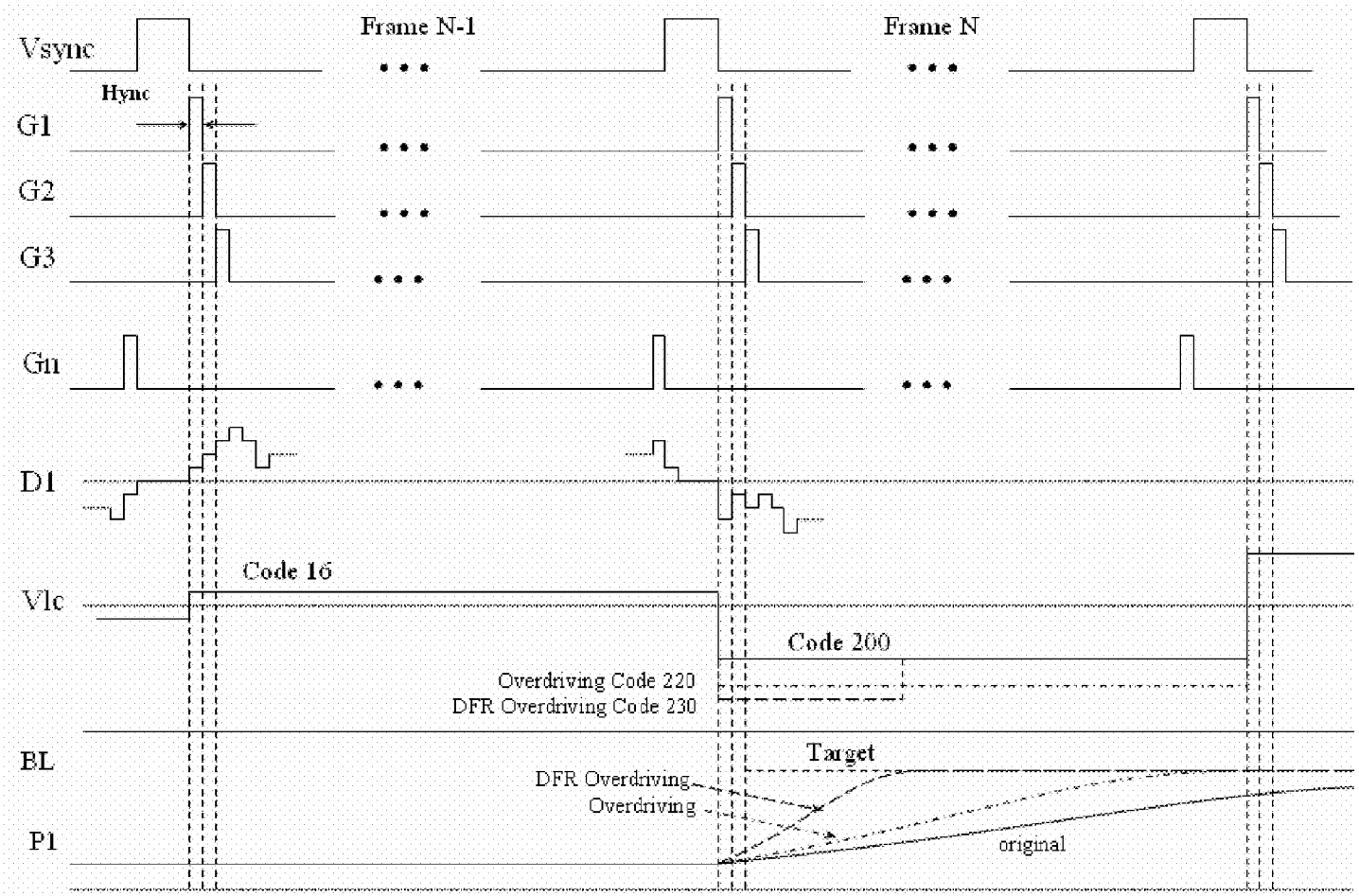
FIG.1b (Prior Art)
FIG. 1*b* is a timing diagram showing the waveforms of various signals of the LCD device of FIG. 1*a*.
Figure 1C:
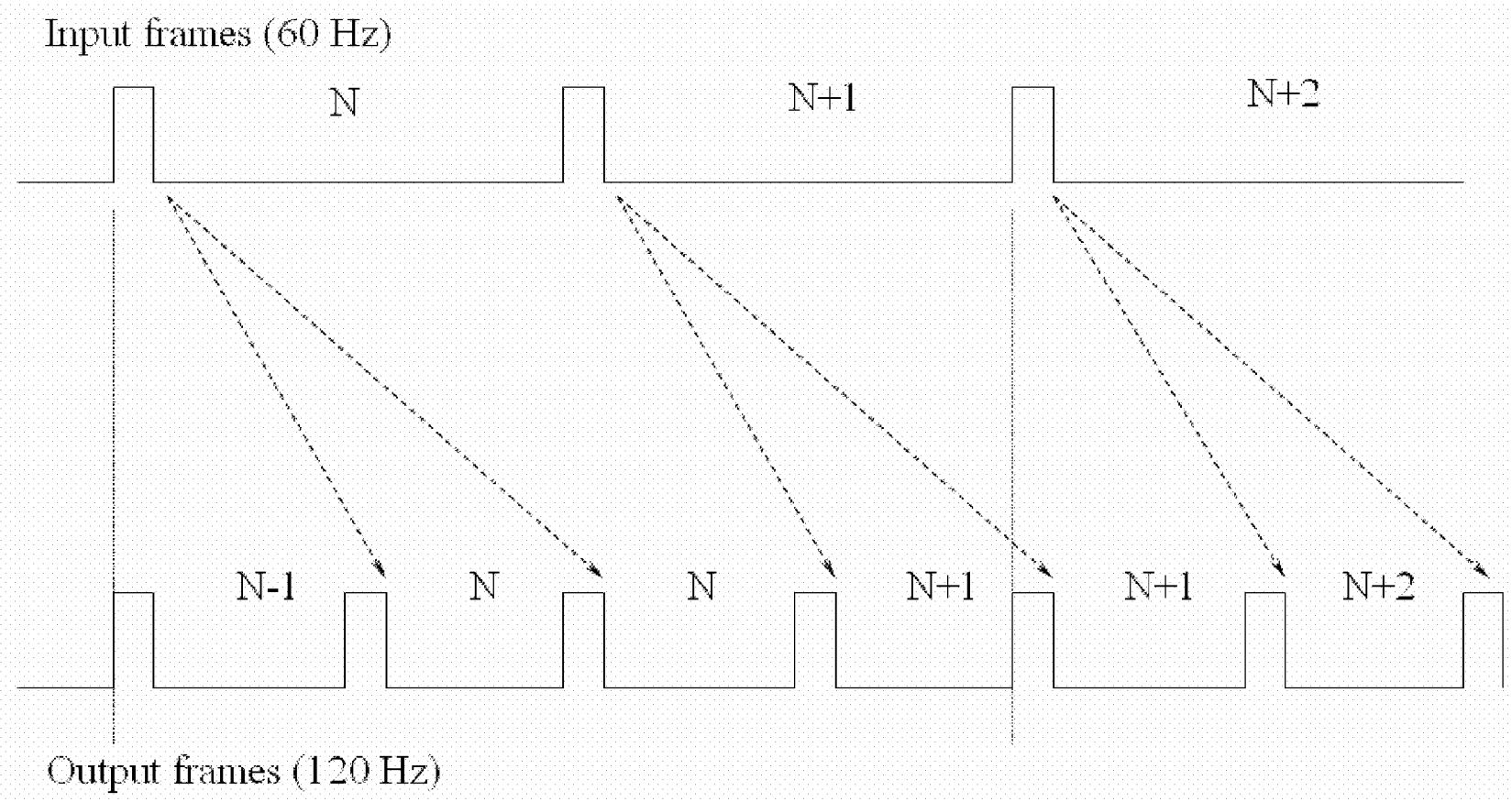
FIG.1c (Prior Art)
FIG. 1*c* is a timing diagram showing the input frame sequence and the output frame sequence of a LCD device using double frame rate acceleration method.
Figure 1D:
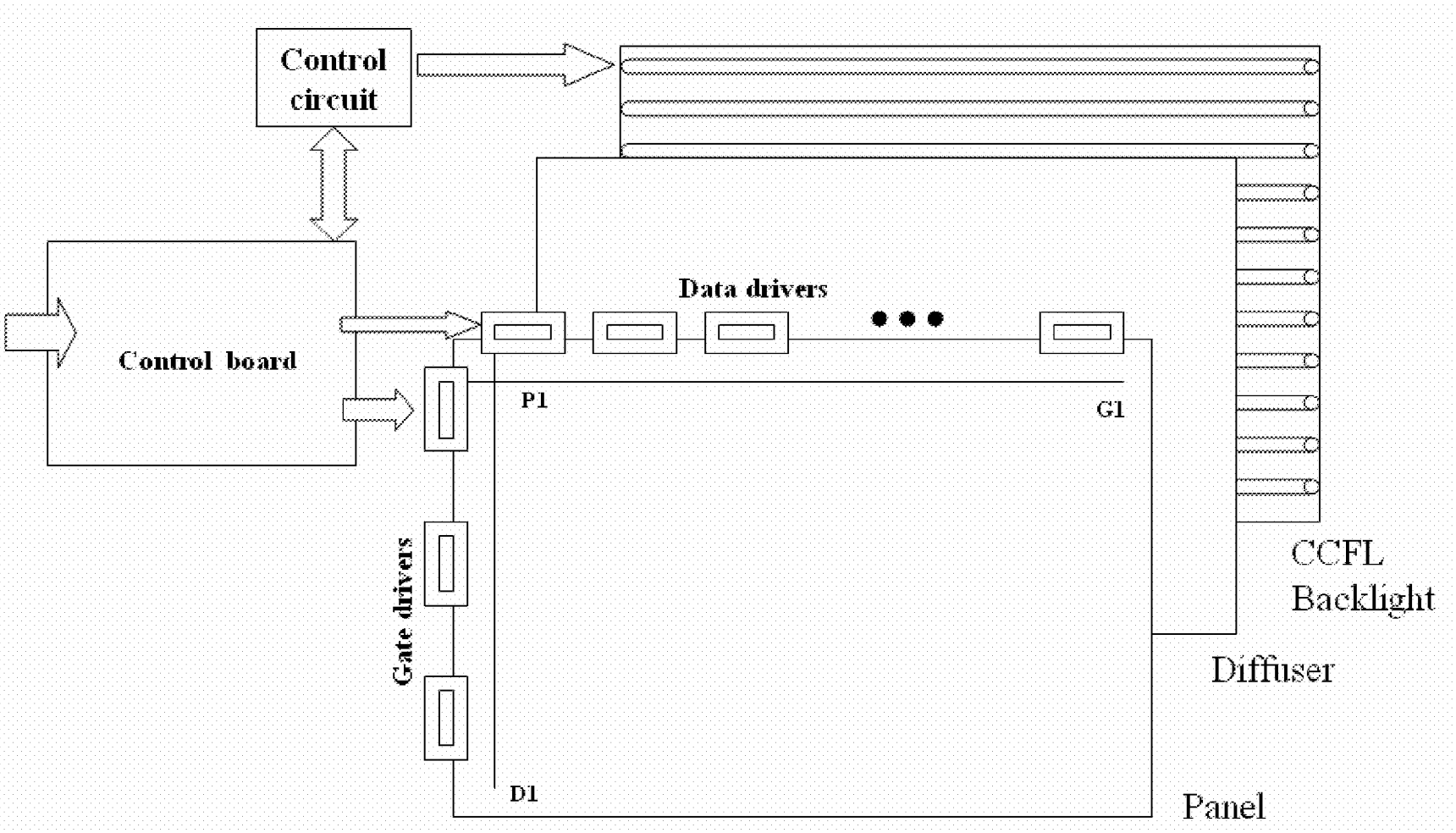
FIG.1d (Prior Art)
FIG. 1*d* is a schematic diagram showing the architecture of a conventional LCD device using CCFL as backlight.

Using the embodiment shown in FIG. 3 as an example, when the frame N is output for the first time and during its 1/108-second frame time, the scan lines of the frame is enabled one by one, each for 1/Hync second, from top to bottom (as pointed out in FIG. 1*b*). During the time when a scan line is enabled, the pixels of the scan line are all applied with overdriving voltages. Then, during the subsequent 1/108 second before the scan line is enabled again, the gray levels of the pixels of the scan line gradually approach their target gray levels. If the backlight is tuned on, the transient behavior the scan lines' pixels will be manifested. On the other hand, if the backlight is turned off until the scan line is enabled again, the transient behavior will not be accentuated. Accordingly, within the 1/108-second frame time for the first output frame N, the rows of light source of the backlight module is sequentially turned off. Then, within the 1/108-second frame time for the second output frame N, the rows of light source of the backlight module is sequentially turned on row-by-row again.

As mentioned earlier, when overdriving and the present invention are integrated, the pixels of every new output frame are applied with overdriving voltages and the pixels of every repeated frame are applied with the target driving voltages. Then, if the backlight control is further integrated, when there are repeated frames being output as shown in FIG. 3 and for one of repeated frame where overdriving voltages are applied, the rows of the backlight are turned off sequentially and correspondingly to line-by-line enablement of the scan lines. Based on the same principle, for the black frames of FIGS. 4*a* and 4*b*, the backlight can be turned in the same manner to make them "darker."

Figure 5A:
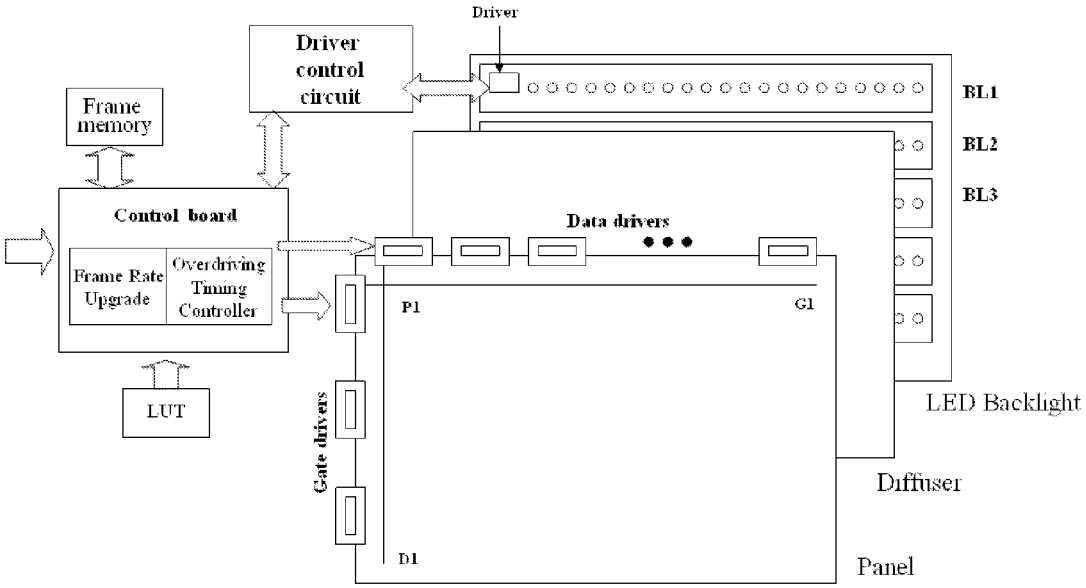
FIG. 5*a* is a schematic diagram showing an implementation scenario of the present invention.
Figure 5B:
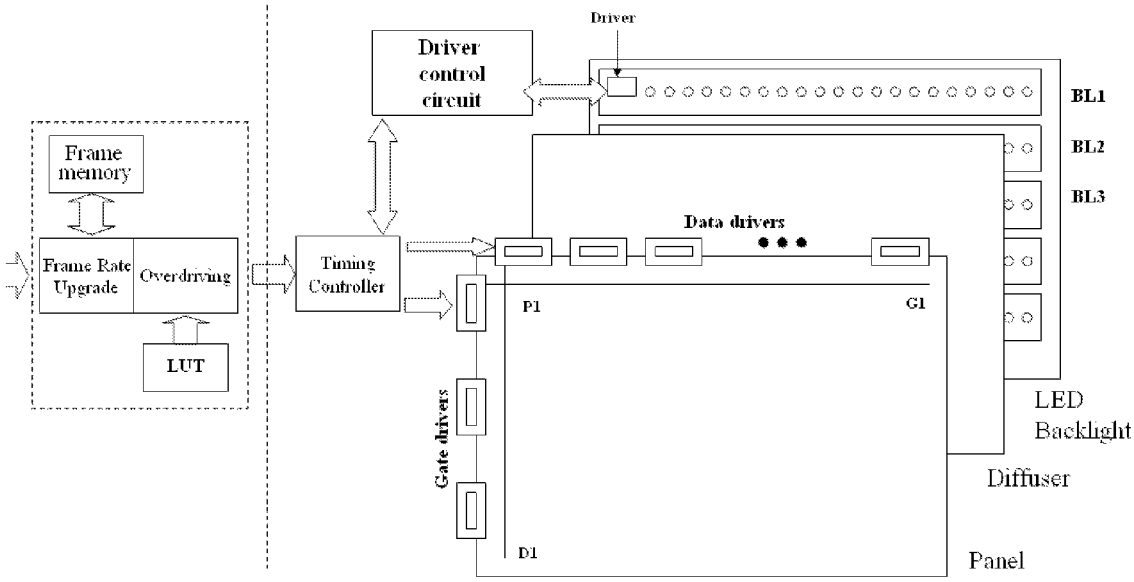
FIG. 5*b* is a schematic diagram showing another implementation scenario of the present invention.

The method disclosed in the present invention can be implemented in the two modules marked as "frame rate update" and "overdriving timing controller" of the LCD device's control board as shown in FIG. 5*a*. Some of the logics can also be implemented in a look-up table (LUT) external to the control board. The module marked as "Frame memory" is for the temporary storage of the frame data. As to the backlight control, it can be implemented in the driver control circuit to the backlight module. In other words, what is shown in FIG. 5*a* is an application scenario where the method is completely implemented in the panel side while FIG. 5*b* shows another scenario where the overdriving and the frame rate increase are implemented as part of the circuit of the LCD device (to the left of the dotted line) and the backlight control is implemented in the driver control circuit in panel side. The advantage of the architecture of FIG. 5*b* is that, if the backlight control is not implemented, many existing conventional panel (to the right of the dotted line) can be adopted. The present invention can also be implemented in various other ways. For example, the frame rate increase is implemented in the device-side circuit to the left of the dotted line while the rest of the present invention such as overdriving and backlight control is implemented in the panel-side circuit to the right of the dotted line.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for enhancing the response speed of a display device, said display device having a panel and a backlight module positioned behind said panel, said panel having a plurality of horizontal scan lines, a plurality of vertical data lines, and a plurality of pixels each located at the intersection of a said data line and a said scan line, a said pixel being turned on by enabling said scan line, applying a driving voltage via said data line, and illuminating said backlight behind said pixel, each said pixel having a delay property where a grey level of said pixel approaches a target grey level corresponding to a target driving voltage, said method comprising the steps of:

receiving a sequence of input frames having an input frame rate and outputting a sequence of output frames having an output frame rate equal to p/q (p, q being natural number and p>q) times of said input frame rate;

wherein, in a period of time equal to the least common multiple of the input and output frame times, q input frames are output and (p−q) transient frames are generated and inserted to at least one of (q+1) appropriate places before or after said q output frames in said output frame sequence; and each said transient frame is produced based on the complete data of a latest completely received said input frame and the data of an input frame concurrently received;

wherein one of every two adjacent said output frames is replaced by a black frame; and, when three identical said output frames are to be output in a row and for two consecutive ones of said three output frames, the pixels of said two output frames are applied with said target driving voltages.

2. The method according to claim 1, wherein a said transient frame is produced by repeating a latest completely received said input frame.

3. The method according to claim 1, wherein, for a said output frame that is different from an immediately previous said output frame, the pixels of said output frame are applied with overdriving voltages larger than said target driving voltages; and, for a said output frame that is identical to said immediately previous output frame, the pixels of said output frame are applied with said target driving voltages.

4. The method according to claim 1, wherein one of every two adjacent said output frames is replaced by a black frame.

5. The method according to claim 1, wherein one of every two adjacent said output frames is replaced by a black frame; and, when three identical said output frames are to be output in a row and for two consecutive ones of said three output frames, the pixels of a first one of said two output frames are applied with said target driving voltages, and the pixels of a second one of said two output frames are applied with driving voltages smaller than said target driving voltages.

6. The method according to claim 1, wherein said display device is one of a LCD device, a plasma display device, and an OLED device.

7. The method according to claim 1, wherein said backlight module is one of a LED-based direct-lit backlight module and a CCFL-based direct-lit backlight module.

8. The method according to claim 3, wherein said backlight module has a plurality of horizontal rows of light source; and, for said output frame where said overdriving voltages are applied, said rows of light source are turned off row by row correspondingly to the line-by-line enablement of said scan lines.

9. The method according to claim 4, wherein said backlight module has a plurality of horizontal rows of light source; and, for each said black output frame, said rows of light source are turned off row by row correspondingly to the line-by-line enablement of said scan lines.

10. The method according to claim 1, wherein said backlight module has a plurality of horizontal rows of light source; and, for each said black output frame, said rows of light source are turned off row by row correspondingly to the line-by-line enablement of said scan lines.

11. The method according to claim 5, wherein said backlight module has a plurality of horizontal rows of light source; and, for each said black output frame, said rows of light source are turned off row by row correspondingly to the line-by-line enablement of said scan lines.

12. A method for enhancing the response speed of a display device, said display device having a panel and a backlight module positioned behind said panel, said panel having a plurality of horizontal scan lines, a plurality of vertical data lines, and a plurality of pixels each located at the intersection of a said data line and a said scan line, a said pixel being turned on by enabling said scan line, applying a driving voltage via said data line, and illuminating said backlight behind said pixel, each said pixel having a delay property where a grey level of said pixel approaches a target grey level corresponding to a target driving voltage, said method comprising the steps of:

receiving a sequence of input frames having an input frame rate and outputting a sequence of output frames having an output frame rate equal to p/q (p, q being natural number and p>q) times of said input frame rate;

wherein, in a period of time equal to the least common multiple of the input and output frame times, q input frames are output and (p−q) transient frames are generated and inserted to at least one of (q+1) appropriate places before or after said q output frames in said output frame sequence; and each said transient frame is produced based on the complete data of a latest completely received said input frame and the data of an input frame concurrently received;

wherein one of every two adjacent said output frames is replaced by a black frame; and, when three identical said output frames are to be output in a row and for two consecutive ones of said three output frames, the pixels of a first one of said two output frames are applied with said target driving voltages, and the pixels of a second one of said two output frames are applied with driving voltages smaller than said target driving voltages.

13. The method according to claim 12, wherein a said transient frame is produced by repeating a latest completely received said input frame.

14. The method according to claim 12, wherein, for a said output frame that is different from an immediately previous said output frame, the pixels of said output frame are applied with overdriving voltages larger than said target driving voltages; and, for a said output frame that is identical to said immediately previous output frame, the pixels of said output frame are applied with said target driving voltages.

15. The method according to claim 12, wherein one of every two adjacent said output frames is replaced by a black frame.

16. The method according to claim 12, wherein one of every two adjacent said output frames is replaced by a black frame; and, when three identical said output frames are to be output in a row and for two consecutive ones of said three output frames, the pixels of said two output frames are applied with said target driving voltages.

17. The method according to claim 12, wherein said display device is one of a LCD device, a plasma display device, and an OLED device.

18. The method according to claim 12, wherein said backlight module is one of a LED-based direct-lit backlight module and a CCFL-based direct-lit backlight module.

19. The method according to claim 14, wherein said backlight module has a plurality of horizontal rows of light source; and, for said output frame where said overdriving voltages are applied, said rows of light source are turned off row by row correspondingly to the line-by-line enablement of said scan lines.

20. The method according to claim 15, wherein said backlight module has a plurality of horizontal rows of light source; and, for each said black output frame, said rows of light source are turned off row by row correspondingly to the line-by-line enablement of said scan lines.

21. The method according to claim 16, wherein said backlight module has a plurality of horizontal rows of light source; and, for each said black output frame, said rows of light source are turned off row by row correspondingly to the line-by-line enablement of said scan lines.

22. The method according to claim 12, wherein said backlight module has a plurality of horizontal rows of light source; and, for each said black output frame, said rows of light source are turned off row by row correspondingly to the line-by-line enablement of said scan lines.

* * * * *